United States Patent [19]

Baker

[11] Patent Number: 4,497,531

[45] Date of Patent: Feb. 5, 1985

[54] ELECTRICAL CONNECTOR

[75] Inventor: Robert W. Baker, Harrow, England

[73] Assignee: AMP Incorporated, Harrisburg, Pa.

[21] Appl. No.: 399,505

[22] Filed: Jul. 19, 1982

[30] Foreign Application Priority Data

Jul. 23, 1981 [GB] United Kingdom ..... 8122671

[51] Int. Cl.[3] ..... H01R 13/52

[52] U.S. Cl. ..... 339/94 M

[58] Field of Search ..... 339/94, 103 B, 217 R, 339/217 S; 174/152, 153, 65 SS

[56] References Cited

U.S. PATENT DOCUMENTS

| | | | |
|---|---|---|---|
| 3,072,415 | 1/1963 | Lombard et al. | 339/94 R |
| 3,076,168 | 1/1963 | Keen | 339/60 |
| 3,517,373 | 6/1970 | Jamon | 339/94 |
| 3,633,150 | 1/1972 | Swartz | 339/36 |
| 4,029,382 | 6/1977 | Koda | 339/94 M |

FOREIGN PATENT DOCUMENTS

| | | | |
|---|---|---|---|
| 33031 | 8/1981 | European Pat. Off. . | |
| 35378 | 9/1981 | European Pat. Off. . | |
| 2232846 | 1/1975 | France . | |
| 587643 | 5/1947 | United Kingdom | 339/94 M |
| 589697 | 6/1947 | United Kingdom . | |

*Primary Examiner*—Eugene F. Desmond

*Attorney, Agent, or Firm*—Robert W. J. Usher

[57] ABSTRACT

An electrical connector housing (3, 4) is sealed at its conductor-entry face by means of a sealing member (14) which is compressed against the face and into engagement with a shroud (12) surrounding the face and with conductors (8) passing through holes (15) in the sealing member (14), by means of a lid (17) which is latched to the shroud (12). The sealing member (14) when compressed is also engaged by terminals (6, 7) terminating the conductors (8) and prevents back-out of the terminals (6, 7) from their passageways (5) in the housing (3, 4).

4 Claims, 2 Drawing Figures

ELECTRICAL CONNECTOR

This invention relates to an electrical connector, and particularly to an electrical connector comprising a housing of insulating material formed with a plurality of through passageways each to receive an electrical terminal terminating an electrical conductor, each passageway extending from a mating face to an opposite, conductor-entry face of the housing.

Many forms of such electrical connectors are known, and for certain applications, for example in automobiles, there is a need for such a connector which is sealed against the ingress of moisture thereby to avoid the possibility of shorting between terminals of the connector which the ingress of moisture could bring.

To provide complete sealing it is necessary to provide sealing means at the conductor-entry end of each passageway in the housing, and at the mating face of the housing to provide sealing between the mating face and a mated connector.

In British Patent Specification No. 2003333A there is disclosed a sealed electrical connector as discussed above in which each passageway is sealed at the conductor-entry face by an individual sealing boot which provides sealing between the housing and a conductor entering the passageway at the conductor-entry face, and which is sealed at the mating face by an O-ring extending about the periphery of the mating face and providing sealing between the connector and a further connector when mated therewith.

With this known connector assembly of the individual sealing boots can be a time consuming operation, and since each sealing boot is retained in the associated passageway only by frictional engagement with the walls of the passageway the sealing boot offers little if any resistance to removal of a terminal with a conductor connected thereto received in the passageway. Thus, if the terminal is not adequately secured in the passageway by the normally provided retention lance on the terminal engaging a shoulder in the housing, or other securing system, then a pull on the conductor can remove the terminal from the passageway together with the sealing boot, or can at least dislodge the sealing boot such that effective sealing is not provided. A further difficulty which can arise with this known connector is that due to the use of an O-ring to effect sealing at the mating face, in the event that one of the sealing boots fails then any moisture which enters past the defective sealing boot and passes along the passageway to the mating face of the connector can then produce a short circuit between terminals of the connector since the passageways are not individually sealed at the mating face.

According to this invention an electrical connector comprising a housing of insulating material formed with a plurality of through passageways each to receive an electrical terminal terminating an electrical conductor, each passageway extending from a mating face to an opposite, conductor-entry face of the housing, includes an axially extending shroud surrounding the conductor-entry face of the housing and defining a cavity into which the conductor-entry ends of the passageways open; a single sealing member receivable in the cavity and having a plurality of holes therethrough each sized to receive and grip a conductor passing through the sealing member into a respective passageway in the housing; and a sealing member retaining lid formed with a plurality of through holes each to pass a terminal entering a respective passageway in the housing, the lid serving to close the cavity and compress the sealing member between the lid and the conductor-entry face of the housing and into sealing engagement with the shroud and with conductors passing through the holes in the sealing member, the lid and the shroud being formed with co-operating latching means serving to latch the lid to the housing in the closed position.

An electrical connector assembly comprising two connectors according to this invention will now be described by way of example with reference to the drawings, in which.

Figure 1:
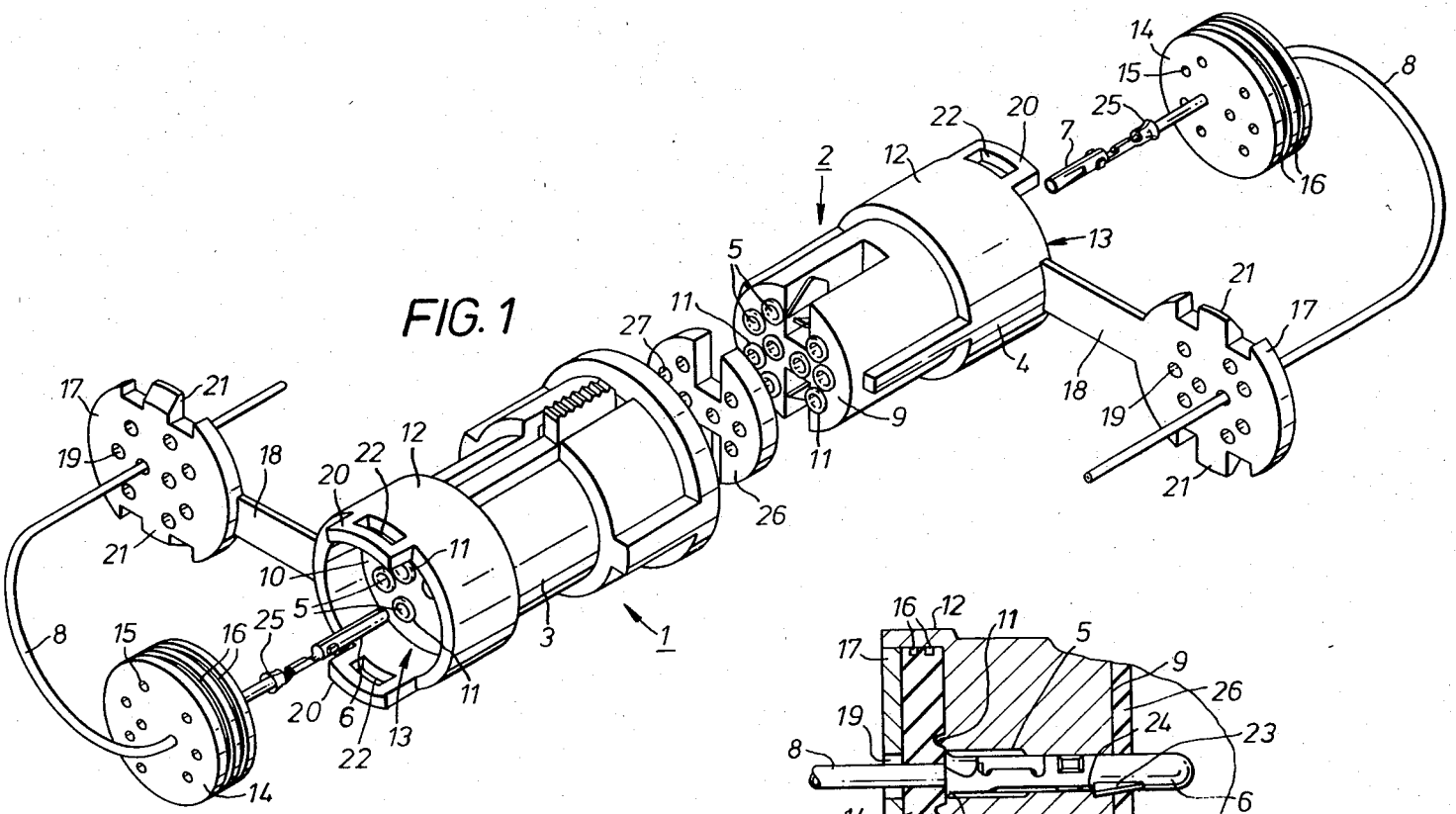
FIG. 1 is a perspective view of the assembly in a disassembled state.

The assembly shown comprises a pair of matable connectors 1 and 2, the connector 1 comprising a housing 3 moulded from electrical insulating plastics material, and the connector 2 comprising a similarly formed housing 4.

The mating ends of the connectors 1 and 2, as can clearly be seen from the drawings, differ, but an understanding of the differences is not necessary to an understanding of the present invention, the mating ends of the connectors 1 and 2 will not therefore be described in detail herein. However, attention is directed to European Patent Application No. 81.301667.2 (U.S. patent application Ser. No. 256650) which includes a description of the system for latching the two connectors 1 and 2 together.

Each connector housing 3 or 4 is formed with a plurality of through passageways 5 each to receive an electrical terminal 6 or 7 terminating an insulated electrical conductor 8. The terminals 6 of the connector 1 are pins which mate with the socket terminals 7 of the connector 2. Each passageway 5 extends from a mating face 9 to an opposite conductor-entry face 10 of the associated housing 3 or 4, and is surrounded at the conductor-entry face 10 by an individual annular rib 11. There is also a rib 11 at the mating face ends of the passageways 5 in the housing 4.

Each housing 3 or 4 includes an axially extending shroud 12 surrounding the conductor-entry face 10 of the housing 3 or 4 and defining a cavity 13 into which the conductor-entry ends of the passageways 5 open.

Each connector 1 or 2 also includes a sealing member 14 formed of elastomeric material and having a plurality of holes 15 therethrough each sized to receive and grip a conductor 8 passing through the sealing member 14 into a respective passageway 5 in the housing 3 or 4. The sealing member 14 is receivable in the cavity 13 in the associated housing 3 or 4 in sealing engagement with the wall of the shroud 12, and is formed with a number of circumferential grooves 16 which serve to enhance the sealing provided.

Integrally formed with each housing 3 or 4 is a sealing member retaining lid 17 which is hingedly connected to the housing 3 or 4 by a hinge strap portion 18, and is formed with a plurality of through holes 19 each to pass a terminal 6 or 7 entering a respective passageway 5 in the housing 3 or 4.

Figure 2:
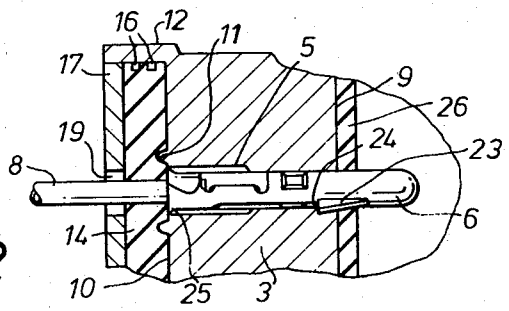
FIG. 2 shows a detail of one of the connectors in the assembled state.

The lid 17 is movable between an open position, shown in FIG. 1, remote from the cavity 13 to permit insertion of the sealing member 14 into the cavity 13, and a closed position, shown in FIG. 2, closing the cavity 13 and compressing the sealing member 14 between the lid 17 and the conductor-entry face 10 of the housing 3 or 4 and into sealing engagement with the shroud 12 and with the conductors 8 passing through the holes 15 in the sealing member 14. The sealing provided at the conductor-entry ends of the passageways 5 is enhanced by the ribs 11, and the sealing provided at the shroud 12 is enhanced by the grooves 16 in the sealing member 14, as shown in FIG. 2.

The lid 17 and the shroud 12 of each housing 3 or 4 are formed with co-operating latching means comprising a pair of diametrically opposed apertured lugs 20 extending axially from the shroud 12 of the housing 3 or 4, and projections 21 on the lid 17 receivable in the apertures 22 in the lugs 20, which latching means serve to latch the lid in its closed position.

To assemble a connector 1 or 2, terminals 6 or 7 terminating leads 8 are passed through the holes 19 in the lid 17 and then through the holes 15 in the sealing member 14 which is then positioned in the cavity 13 of the housing 3 or 4. The terminals 6 or 7 are pushed into individual passageways 5 in the housing 3 or 4 and become latched therein in known manner by means of a lance 23 on the terminal 6 or 7 engaging a shoulder 24 formed in the passageway 5. The lid 17 is then moved from its first into its second position to become latched to the housing 3 or 4 by the co-operating projections 21 and lugs 20. In its second position the lid 17 compresses the sealing member 14 into intimate engagement with the face 10 and the housing 3 or 4, with its ribs 11, with the shroud 12, with the inner surface of the lid 17, and with the conductors 8 passing through the sealing member 14, thus providing effective individual sealing for each of the passageways 5. Further, as the lid 17 approaches its second position the sealing member 14 is moved towards the face 10 of the housing 3 or 4 and will thus push fully home into the associated passageway 5 any terminal 6 or 7 which has not been fully inserted into the passageway 5 as necessary.

As shown in the drawings, each terminal 6 or 7 is provided with a belled end 25 adjacent the associated conductor 8, this belled end providing a relatively large diameter portion which is engaged by the sealing member 14 in the compressed state, this engagement serving to prevent back-out of the terminal 6 or 7 from the passageway 5 when a pull is applied to the conductor 8 in the event that the latching between the lance 23 on the terminal 6 or 7 and the shoulder 24 in the passageway 5 is not effective, the sealing member 14 being prevented from movement out of the cavity 13 by the latched lid 17. Otherwise each terminal 6 or 7 can be provided with a conventional insulation support crimping ferrule, and a further third ferrule which when crimped about the conductor 8 provides a relatively large end for engagement by the sealing member 14.

When the connectors 1 and 2 are mated their mating faces 9 are sealed by a single sealing member 26 formed with a plurality of holes 27 through which the terminal pins 6 pass as shown in FIG. 2.

What is claimed is:

1. An electrical connector comprising a housing of insulating material formed with a plurality of through passageways each to receive an electrical terminal terminating an electrical conductor, each passageway extending from a mating face to an opposite, conductor-entry face of the housing, including an axially extending shroud surrounding the conductor-entry face of the housing and defining a cavity into which the conductor-entry ends of the passageways open; a single sealing member receivable in the cavity and having a plurality of holes therethrough each sized to receive and grip a conductor passing through the sealing member into a respective passageway in the housing; and a sealing-member-retaining lid formed with a plurality of through holes each to pass a terminal entering a respective passageway in the housing, the lid serving to close the cavity and compress the sealing member between the lid and the conductor-entry face of the housing and into sealing engagement with the shroud and with conductors passing through the holes in the sealing member, the lid and the shroud being formed with cooperating latching means serving to latch the lid to the housing in the closed position, the lid being hingedly connected to the housing by means of an integrally formed hinge strap portion, and being movable between an open position remote from the cavity to permit insertion of the sealing member into the cavity, and a closed position closing the cavity.

2. A connector as claimed in claim 1, in which the conductor-entry end of each passageway is surrounded by an individual rib extending into the cavity and serving to enhance the sealing between the conductor-entry face of the housing and the sealing member.

3. A connector as claimed in claim 1, in which the sealing member is formed with a number of circumferential grooves serving to enhance the sealing between the sealing member and the shroud.

4. A connector as claimed in claim 1, in which the latching means comprises apertured lugs extending axially from the shroud, and projections on the lid receivable in the apertures in the lugs on the shroud.

* * * * *